US008820025B1

(12) United States Patent
Rochas

(10) Patent No.: US 8,820,025 B1
(45) Date of Patent: Sep. 2, 2014

(54) UNIVERSAL NODE FOR SPACE FRAME STRUCTURES

(76) Inventor: Alexis Rochas, Los Angeles, CA (US)

( * ) Notice: Subject to any disclaimer, the term of this patent is extended or adjusted under 35 U.S.C. 154(b) by 0 days.

(21) Appl. No.: 13/540,449

(22) Filed: Jul. 2, 2012

Related U.S. Application Data

(60) Provisional application No. 61/503,323, filed on Jun. 30, 2011.

(51) Int. Cl.
*E04H 12/00* (2006.01)
*E04B 7/08* (2006.01)
*E04B 1/19* (2006.01)

(52) U.S. Cl.
CPC ..... *E04B 1/1906* (2013.01)
USPC ..... 52/653.2; 52/81.3; 52/638; 52/648.1; 52/655.2

(58) Field of Classification Search
USPC ..... 52/648.1, 637, 638, 81.3, 81.2, 653.1, 52/653.2, 656.9, 655.1, 655.2; 403/170, 403/171, 173, 174, 175, 176, 178, 217, 218, 403/219
See application file for complete search history.

(56) References Cited

U.S. PATENT DOCUMENTS 3,632,147 A * 1/1972 Finger ..... 403/171
3,857,212 A * 12/1974 Barnett ..... 52/81.3
4,027,449 A * 6/1977 Alcalde Cilveti ..... 52/655.2
4,131,380 A * 12/1978 De Bliquy ..... 403/217
4,480,418 A * 11/1984 Ventrella ..... 52/655.2
4,974,986 A 12/1990 Cook
4,982,546 A 1/1991 Lange
5,069,572 A * 12/1991 Niksic ..... 403/170
5,095,677 A * 3/1992 Godbout et al. ..... 52/655.2
5,265,395 A * 11/1993 Lalvani ..... 52/648.1
5,797,695 A * 8/1998 Prusmack ..... 403/170
6,378,265 B1 * 4/2002 Konstandt ..... 52/655.2
7,896,016 B2 * 3/2011 Shi ..... 135/147
2002/0150444 A1 10/2002 Mhaimeed

* cited by examiner

*Primary Examiner* — Jessica Laux

(74) *Attorney, Agent, or Firm* — Patent Law & Venture Group; Gene Scott

(57) ABSTRACT

A structural apparatus for carrying loads and transferring forces to ground, the apparatus having a plurality of nodes, each having a spherical core, the core having a spherical surface. Each one of the nodes having a plurality of housing frames secured in fixed selected positions in contact with the surface. Each one of the nodes having a plurality of housing hubs secured by the housing frames in contact with the surface and free to circularly rotate about a radius of the core, and each one of the nodes has a plurality of fasteners, each of the fastener having a head and a shaft extending from the head, the head constrained between the surface and a housing hub positioning the shaft in a radial attitude relative to the core. A plurality of struts interconnect the nodes and the struts are joined with the shafts at their opposing ends.

3 Claims, 5 Drawing Sheets

UNIVERSAL NODE FOR SPACE FRAME STRUCTURES

CROSS-REFERENCE TO RELATED APPLICATIONS

This application is based on a prior filed provisional patent application Ser. No. 61/503,323, filed on Jul. 7, 2011 and claims international date priority therefrom. The subject matter of application 61/503,323 is hereby incorporated hereinto in its entirety.

BACKGROUND

No federally sponsored research or development, and no sequence listing, table, or computer program listing or compact disc appendix is applicable to this application.

The field of the presently described apparatus relates to space frame structures, and particularly to node elements, fixtures where two or more struts of the frame are joined. Examples of such nodes are disclosed by Ventrella, U.S. Pat. No. 4,480,418, "Modular System for Space Grid Structures," Cook, U.S. Pat. No. 4,974,986, "Connector for Variable-Shape Spaceframe Structural System," Lange, U.S. Pat. No. 4,982,546, "Space Frame Node," Lalvani, U.S. Pat. No. 5,265,395, "Node Shapes of Prismatic Symmetry for a Space Frame Building System," and Mhaimeed, US 2002/0150444, "Special Bolt and Sleeve Combination for Use in Tube-And-Node Space Frame Systems . . . "

A space frame is typically a lightweight rigid structure constructed from interlocking struts in a geometric pattern. Space frames can be used to span large areas with few interior supports such as columns. Like the truss, a space frame is strong because of the inherent rigidity of the triangle where flexing loads and bending moments are transmitted as tension and compression vectors along the length of each strut. The simplest form of the space frame is a horizontal slab of interlocking square pyramids which might be built from aluminum or tubular steel struts interconnected by fixtures generally referred to by the term "node." This structure may look like the horizontal jib of a tower crane repeated many times to make it wider. A stronger form may comprise interlocking tetrahedral pyramids in which all the struts have unit length. More technically, this is referred to as an isotropic vector matrix, or in a single unit width, an octet truss. More complex variations change the lengths of the struts to curve the overall structure or may incorporate other geometrical shapes.

Space frames are common in building construction such as large roof spans in modern commercial and industrial buildings. Notable examples of buildings based on space frames include: Stansted airport in London, Bank of China Tower and the Louvre Pyramid, Rogers Centre, McCormick Place East in Chicago, Eden Project in Cornwall, England, Globen, the Swedish dome structure which has a diameter of 110 m, and Biosphere 2 in Oracle, Ariz. Large portable stages and lighting gantries are also frequently built from space frames with octet trusses. Today, the octet truss is the structure of choice for holding signs above roads in the United States.

Space frames have been used in automobile and motorcycle chassis wherein the engine and body panels are suspended, and the body panels have little or no structural function. By contrast, in a monocoque design, the body serves as the primary stress bearing and load transferring structure. Tube-frame chassis, adopted from the space frame, are frequently used in racing car designs. The first notable american-produced automobile to incorporate a space frame was the Pontiac Fiero. Fiero frames used 233 individual pieces of steel, weighing in at 6001 bs, to form a very strong and safe automobile. After the Fiero program ended in 1988, this technology was adopted for the Saturn SL series, Pontiac Trans-Sport, and Chevrolet Lumina APV mini-vans. British manufacturer TVR is particularly well known for their tube-frame chassis designs, produced since the 1950s. Other notable examples of tube-frame cars include the Audi A8, Lotus Seven, Ferrari 360, Lamborghini Gallardo, and Mercedes-Benz SLS AMG.

BRIEF SUMMARY AND OBJECTIVES

The presently described apparatus is a highly novel node which is used as an essential joining element in the construction and operation of space frames of the types previously mentioned. The node is an assembly of several distinct parts or elements including a spherical core, at least one, and generally several, housings, and fasteners. Each housing is made-up of a housing frame, and a housing hub. Generally, one end of each space frame strut is engaged with one of the fasteners so that the node is the meeting point of struts coming to the node from different directions. In practice, the node may be a terminal point of a space frame, or it may join two or more struts of the space frame.

In one aspect of the presently described apparatus, the longitudinal axes of all struts which are joined to the node pass through a common point which is the geometrical center of the node's spherical core. This avoids the possibility of force moments on, or within, the node. This very important capability enables the node to pass tensile and compressive forces along the space frame without unwanted stress being applied to the node itself and without generating bending or shear forces on the struts or their interconnections with nodes.

In another aspect of the apparatus, the axis of each fastener is on a radius of the core and movable within a range of angular positions all the while remaining co-radial with the core. Of course, this accounts for the benefit described in the preceding paragraph.

In another aspect of the apparatus, the angular range of positions of each one of the fasteners may be between 45° and 90°.

In another aspect of the apparatus, each of the fasteners may have a threaded stud or a threaded hole and may be rotatable about its radially aligned axes thereby providing a simple and quick means for securely attaching the one end of a strut to the fastener wherein the strut may be adapted for threadedly engaging the fastener.

In another aspect of the apparatus, each one of the housing hubs may be rotatable enabling its engaged fastener to be moved to any position within a solid angle having a cone outer surface defined by the angular range of the possible extreme positions of the fastener.

The details of one or more embodiments of these concepts are set forth herein and other features, objects, and advantages of these concepts will be apparent to those of skill in the art from this writing and drawings, and from the claims.

BRIEF DESCRIPTION OF THE DRAWING

Like reference symbols in the various drawings indicate like elements.

DETAILED DESCRIPTION

Figure 1:
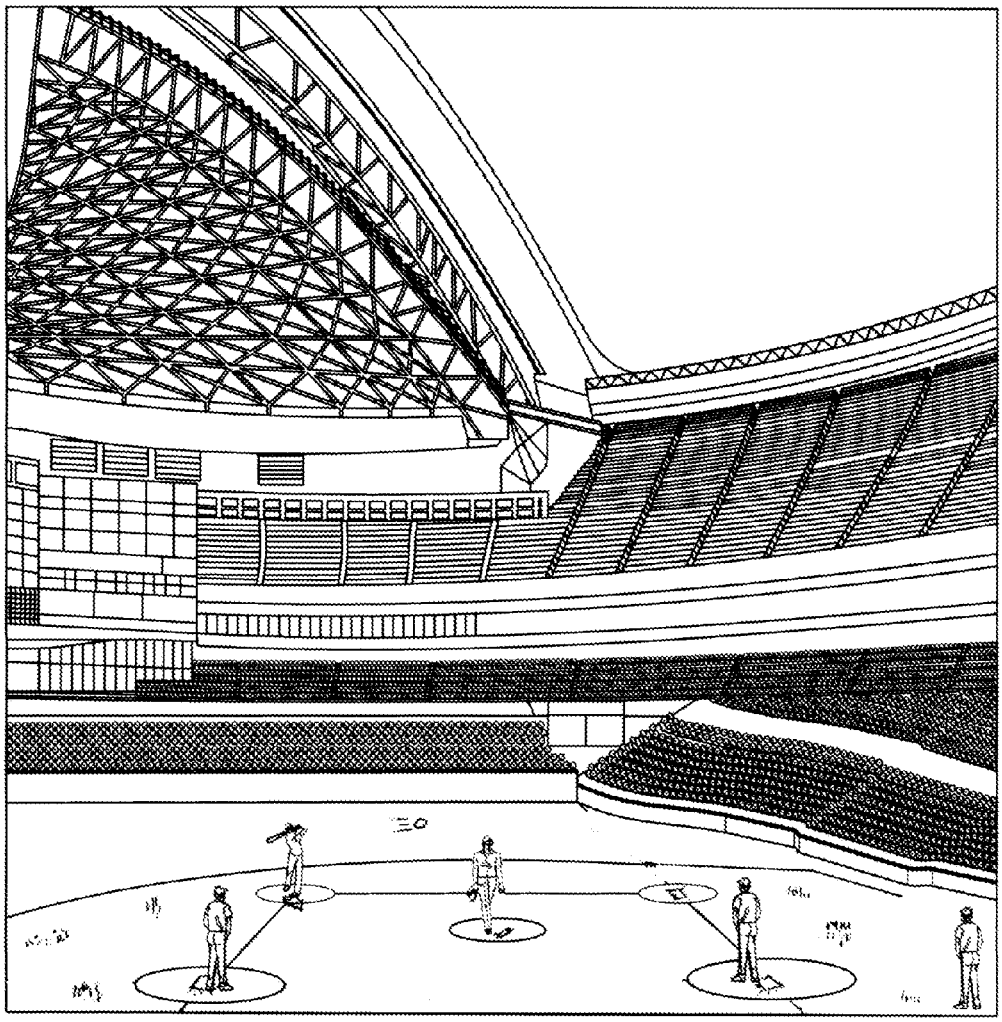
FIG. 1 is an example perspective view of a space frame; in this illustration the Roger's Center in Toronto.

FIG. 1 is an example of a space frame showing its struts and nodes, that is, where the ends of struts converge and are joined. Clearly, as in this case, the struts may be permanently joined as by welding or other fastening means. However, space frames may be light-weight structures that can be used for temporary covers for events such as weddings, and semi-temporary events such as fair pavilions. In these cases it may be desirable to be able to disassemble such frames and re-assembly the components in a different arrangement for a new use or application. The present apparatus, node 10, provides significant advantages for such flexibility as will be described below.

Figure 2:
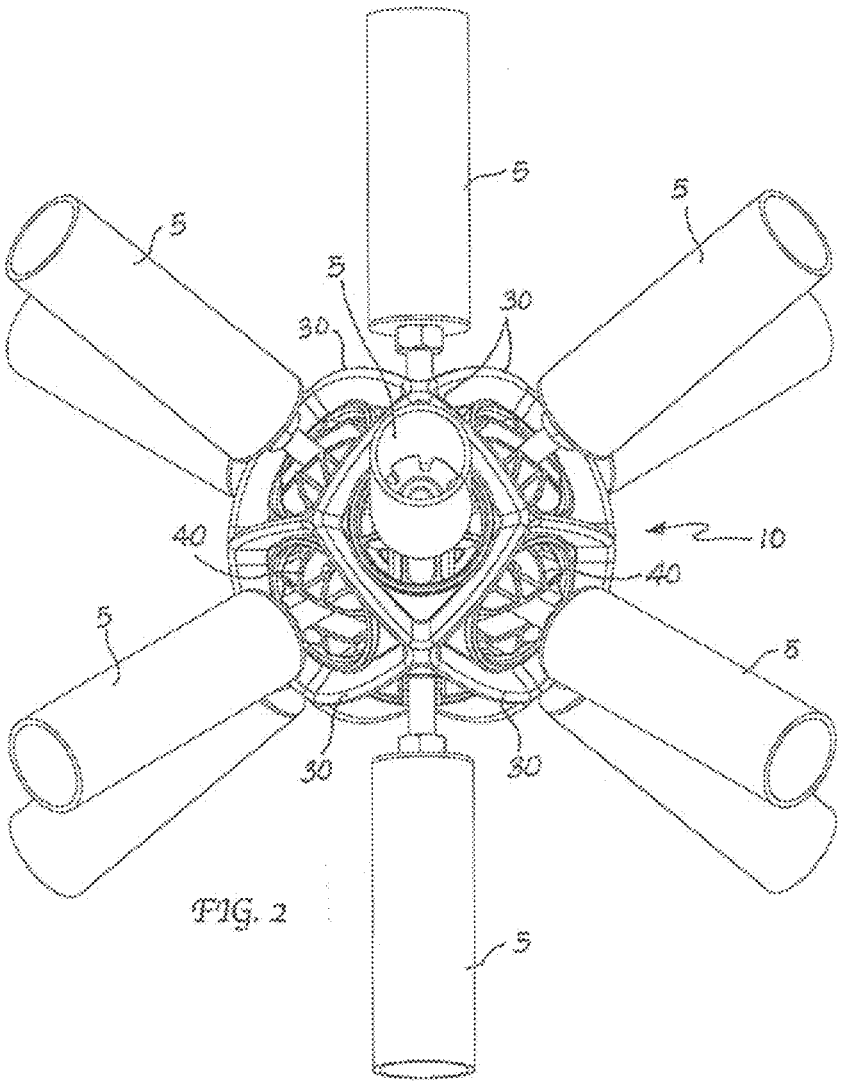
FIG. 2 is an example perspective view of a first embodiment of the node according to the present disclosure showing ends of struts engaged therewith.
Figure 3:
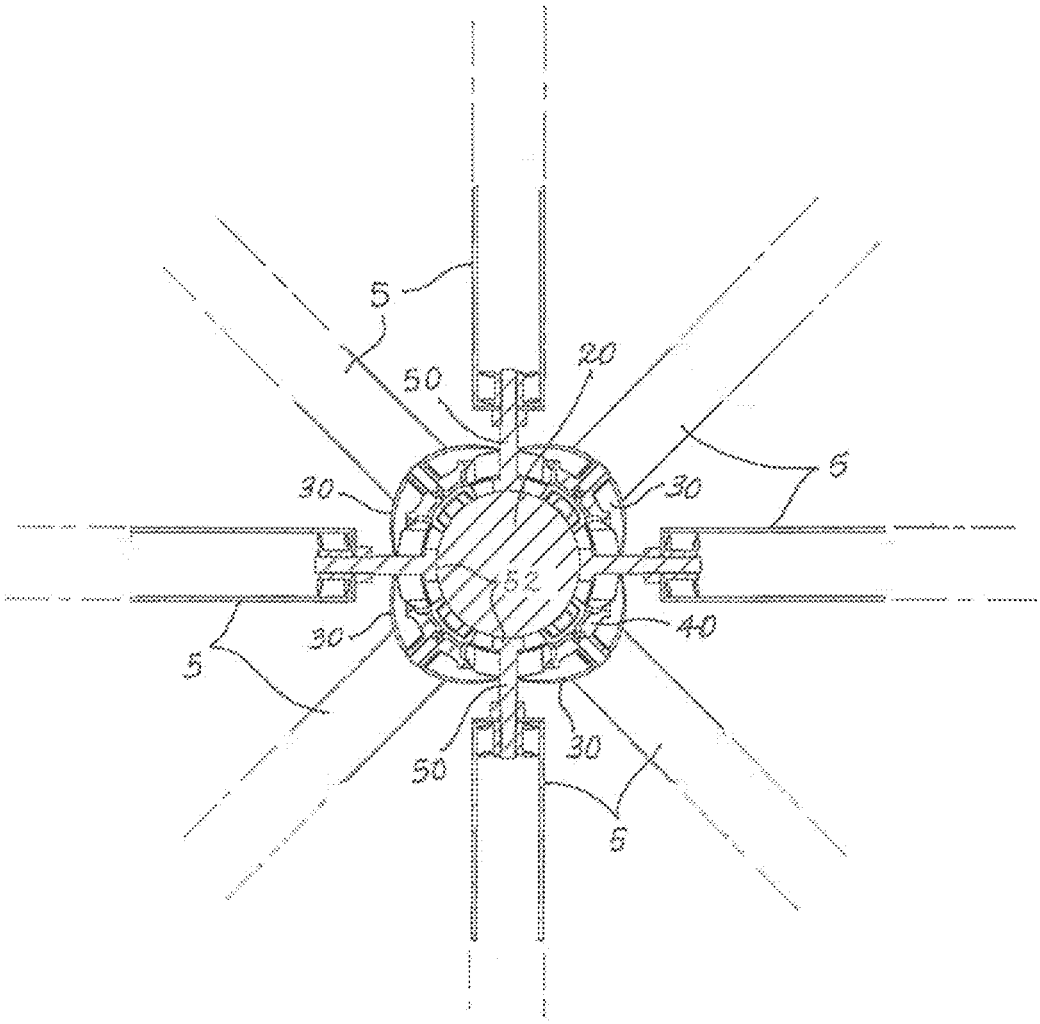
FIG. 3 is an example sectional view of the node of FIG. 2 showing a means for engaging struts with the node.

In FIG. 2 we see that the presently described apparatus, node 10, may be joined by a number of struts 5 which are shown as tubular, but which may be any type of elongated structural element including rods, tubes, girders, and similar structural elements, all of which will be referred to herein solely by the term "strut 5." It should be recognized that each of the struts shown in FIGS. 2-6 represent only one terminal portion of said strut, the strut being shown cut off with a normal and regular edge while, in practice struts 5 may be of any length. FIG. 3 attempts to recognize this actual configuration in length of struts 5 using phantom lines to illustrate that struts 5 extend beyond what is shown in the figures.

Strut 5 may be made of a metal such as aluminum or steel, or alternately may be formed of a plastic, fiber composite, glass or other structural material. The primary requirement of strut 5 is that it must be able to transfer a tensile load without stretching or breaking, and also must be able to handle a compressive load without bending, collapsing or snapping in shear. As to how much load a given strut 5 will handle depends upon design factors such as weight distribution in the space frame, wind loads, kinetic loads due to moving the space frame, local loads applied as for instance by: lighting fixtures, heaters, speakers, skin plates, or signs, which may be attached to or hung from the space frame.

Figures 4A, 4B, 4C:
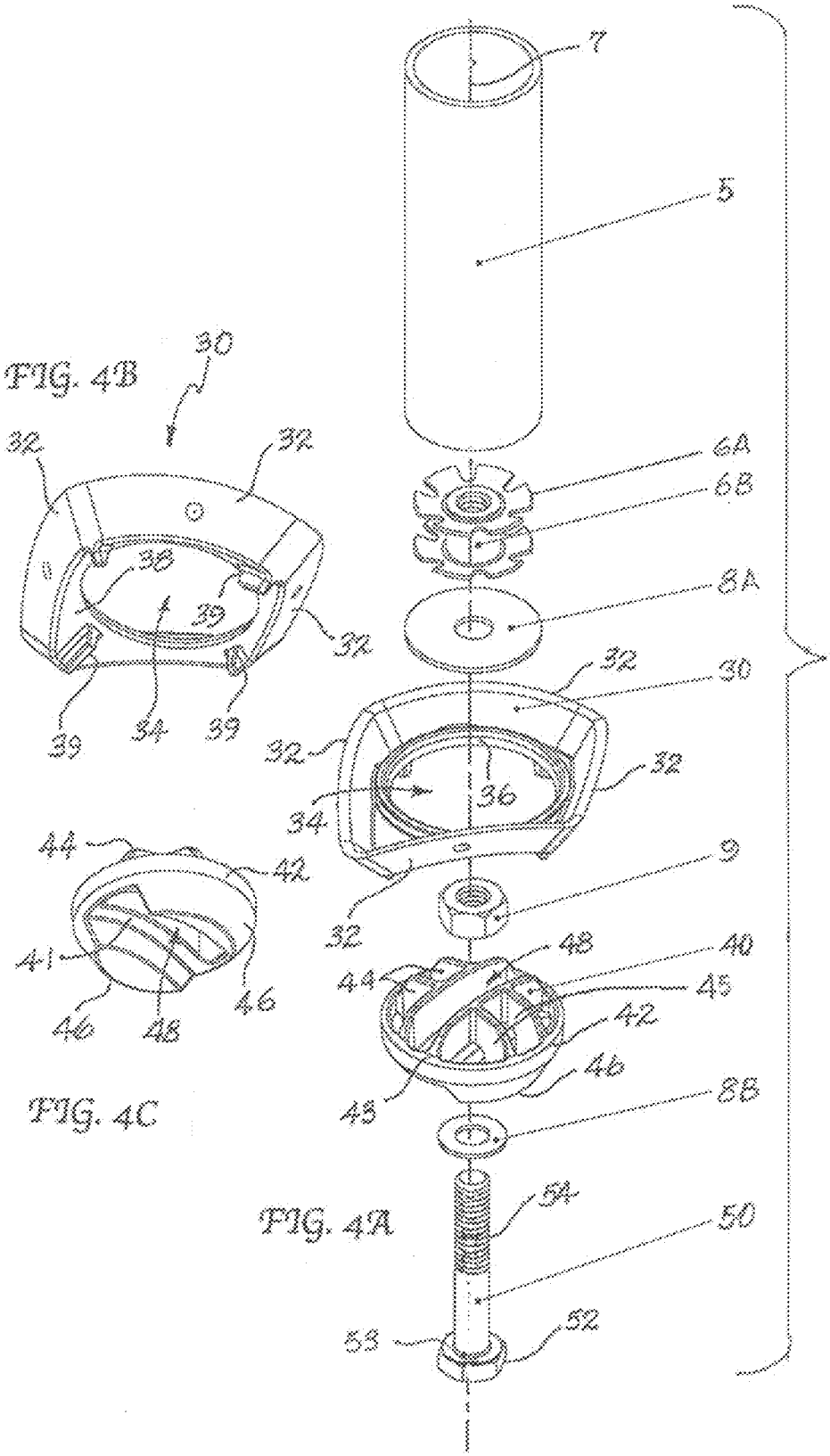
FIG. 4A is an example exploded view of a strut and its attachment means according to FIG. 3 including a housing frame, housing hub, and a fastener.
FIG. 4B is an example bottom perspective view of the housing frame.
FIG. 4C is a bottom perspective view of the housing hub.

In the cross-sectional view of FIG. 3 we see that node 10 incorporates a central spherical core 20 which may be a solid ball, as shown, or it may be a hollow sphere, but in either case, it has a spherical outer surface 22 which is identified in FIG. 5 and which is an operating surface during assembly of the space frame, as will be described. Core 20 may be made of any of the materials mentioned above for struts 5. FIG. 4A shows further details of an array of elements of the present apparatus coaxially arranged on axis 7 and which represent a typical usage to engage strut 5 with node 10. The elements shown in FIG. 4A are from the top of the figure: strut 5, star nut 6A, star washer 6B, large plain washer 8A, housing frame 30, hex nut 9, housing hub 40, small plain washer 8B and fastener 50.

Figure 5:
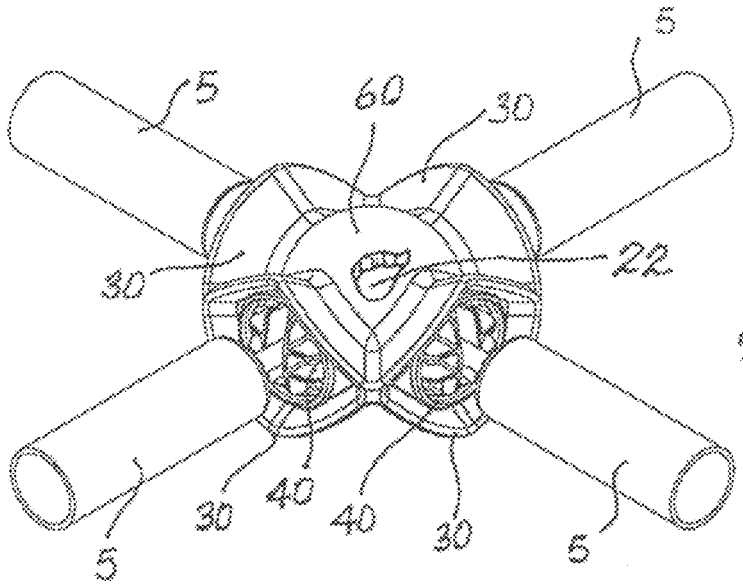
FIG. 5 is an example perspective view of a second embodiment of the present disclosure wherein four housing frames and hubs are used with four struts and a first cover is fixed on top abutting the spherical core and the four frames, and a second identical four sided cover (not visible in this view) is fixed on the bottom of the node in a similar manner.

FIGS. 2, 3, 5 and 6 show that node 10 may include a plurality of housing frames 30. Housing frames 30 may be joined one to the other by fasteners, bonding materials, or other joining methods as known in the art or may be molded in groups forming a monolithic (non-separable) part. Frames 30 may also be joined to surface 22 with common fasteners or by bonding or in other ways. If enough housing frames 30 are applied to spherical core 20 so as to surround it as inferred by FIGS. 2 and 3, or if they cover a majority of its surface 22 as shown in FIG. 5, then the housing frames 30 may not need to be fastened to surface 22 at all, but rather may be secured to spherical core 20 by enclosing it, assuming that the frames 30 are mutually joined to each other. As shown in FIGS. 4A and 4B, housing frame 30 may have a parallelogram-like overall shape defining four perimeter walls 32 defining a central circular aperture 34 with a circular side surface 36. Frame 30 may have a bottom surface 38 and multiple legs 39 as shown in FIG. 4B. Housing frame 30 may be made of nylon or a similar polymer material in order to provide the characteristics of mechanical toughness and low surface friction when sliding against surface 22.

Housing hub 40, as shown in FIGS. 4A and 4C may be a circular part having a circular platform 42 with a superstructure 44 extending upwardly from platform 42, and a pair of downwardly extending feet 46 extensive of platform 42. In use, hub 40 is positioned in contact with both frame 30 and spherical core 20 but is free to rotate within frame 30 which secures hub 40 against core 20. Feet 46, best seen in FIG. 4C, are placed into contact with surface 22 and are curved to fully conform to surface 22. A top, outwardly facing, peripheral edge 43 (FIG. 4A) of platform 42 is in sliding contact with bottom surface 38 (FIG. 4B) of frame 30 which secures hub 40 against surface 22. Therefore, frame 30 and spherical core 20 capture hub 40 in a fixed position on surface 22, but without a significant clamping force, thereby enabling hub 40 to be manually rotated by 360° about axis 7. As shown in FIG. 4A, superstructure 44 provides a diametric slot 48 which extends across aperture 34 of frame 30. Due to the freedom of rotation of hub 40, slot 48 may be positioned with any angular relationship relative to frame 30. Superstructure 44 is in sliding contact with circular side surface 36 of frame 30 which maintains a central concentricity between frame 30 and hub 40.

In FIG. 3 we see that fastener 50 is engaged within slot 48 with head portion 52 in sliding contact with spherical surface 22. Head portion 52 may have a concave bottom surface (not visible). Therefore, head portion 52 is able to slide in surface-to-surface contact with surface 22. Surface 53 of fastener 50 is also in sliding contact with surface 41 of hub 40, see FIG. 4C. Therefore, head portion 52 is sandwiched between surfaces 22 and 41 which orients body portion 54 coaxially with axis 7 and radially with respect to core 20 no-matter the position of fastener 50 within slot 48. Body portion 54 extends through slot 48 and may be threaded, as shown, allowing it to be fastened to strut 5 using the common hardware shown in FIG. 4A as would be assembled easily by one of skill in the art who would also conceive of many alternate attachment schemes. The size of head portion 52 is such that fastener 50 is able but able to move within slot 48 over an angular range of movement while maintaining a radial relationship with spherical core 20. Fastener 50 may be made of steel or similar structural material in order to provide mechanical strength in connecting with strut 5. Since a number of separate fasteners 50 are able to be engaged with a single node 10 as illustrated in the figures, and the force vectors directed along these struts 5 all terminate at the center of spherical core 20 no force moments or node turning forces are created.

Figure 6:
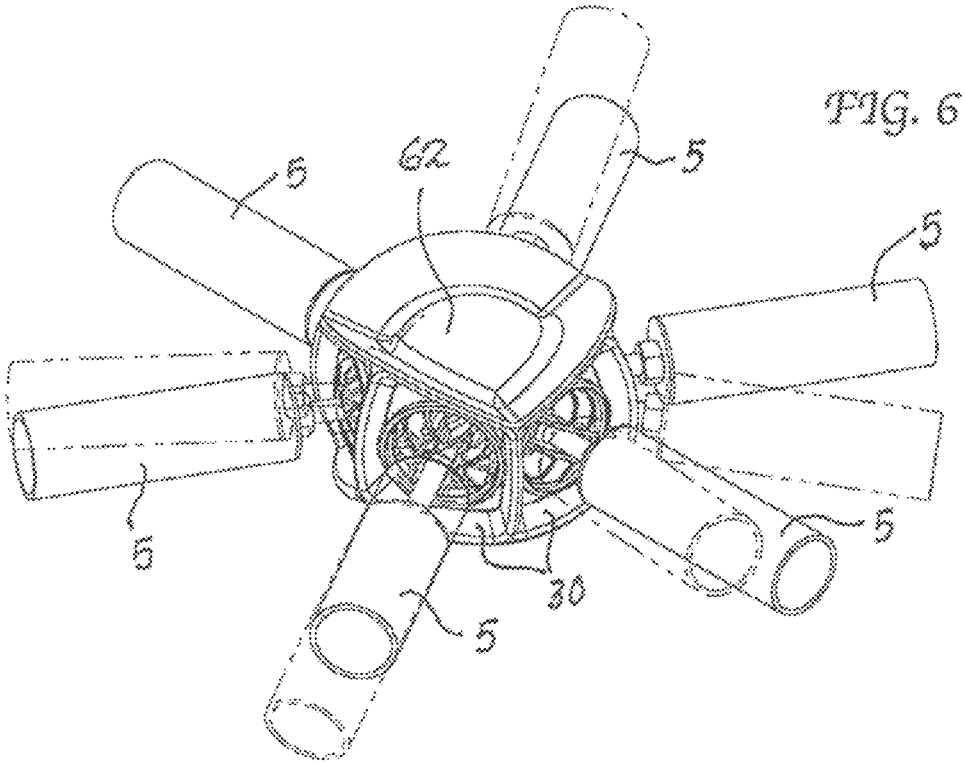
FIG. 6 is an example perspective view of a third embodiment of the present disclosure wherein six housing frames and hubs are used with six struts and a second cover is fixed on top abutting the spherical core and the six frames, while, as above, a second identical cover (not visible in this view) is fixed on the bottom of the node in a similar manner.

In FIG. 2 it is clear that spherical surface 22 may be completely covered by frames 30 and, of course, this depends on how many struts 5 are to be engaged with node 10. However, as shown in FIGS. 5 and 6 we see that when fewer struts 5 are joined to node 10, frames 30 may allow open areas of surface 22 to be exposed. When this is the case, covers 60 (FIG. 5), 61 (FIG. 6), or the like, may be used to engage frames 30 to cover the open spaces and to form a rigid structural shell fully enclosing core 20. Covers 60 and 61 are examples of one way of assuring the positions and proper engagement of frames 30 with node 10 and that hubs 40 and fasteners 50 are able to be precisely located.

Embodiments of the subject apparatus and method have been described herein. Nevertheless, it will be understood that various modifications may be made without departing from the spirit and understanding of this disclosure. Accordingly, other embodiments and approaches are within the scope of the following claims.

What is claimed is:

1. A structural apparatus for transferring forces, the apparatus comprising:

a spherical core having a spherical surface;

a housing frame fixed to the spherical surface, the housing frame having a circular aperture therein;

a housing hub within the circular aperture, the housing hub restrained by the housing frame to sliding rotational contact with the spherical surface, the housing hub having a slot therein; and a fastener restrained by the slot of the housing hub to movement in contact with the spherical surface over a range of radial positions within the slot relative to the spherical core; whereby a combination of the rotational contact of the housing hub, and the range of radial positions of the fastener enable alternative positioning of the fastener within a solid angle.

2. A structural apparatus for transferring forces, the apparatus comprising:

a spherical core having a spherical surface;

a plurality of housing frames fixed to the spherical surface, the housing frames each having a circular aperture therein;

a plurality of housing hubs, each within the circular aperture of a housing frame and restrained by the housing frame to sliding rotational contact with the spherical surface, the housing hubs each having a slot therein; and a plurality of fasteners, each restrained by the slot of a housing hub to movement in contact with the spherical surface over a range of radial positions within the slot relative to the spherical core; whereby a combination of the rotational contact of the housing hubs, and the range of radial positions of the fasteners enable alternative positioning of each of the fasteners within a solid angle.

3. A structural apparatus for transferring forces, the apparatus comprising:

a plurality of nodes;

each said one of the nodes having:

a spherical core with a spherical surface:

a plurality of housing frames fixed to the spherical surface, the housing frames each having a circular aperture therein;

a plurality of housing hubs, each within the circular aperture of a housing frame and restrained by the housing flame to sliding rotational contact with the spherical surface, the housing hubs each having a slot therein; and a plurality of fasteners, each restrained by the slot of a housing hub to movement in contact with the spherical surface over a range of radial positions within the slot relative to the spherical core; whereby a combination of the rotational contact of the housing hubs, and the range of radial positions of the fasteners enable alternative positioning of each of the fasteners within a solid angle a plurality of struts, each of the struts engaged at each end thereof with a one of said fasteners thereby joining two of the nodes for transferring forces between the spherical centers of the nodes.

* * * * *